US005839420A

United States Patent [19]

Thomas

[11] Patent Number: 5,839,420

[45] Date of Patent: Nov. 24, 1998

[54] SYSTEM AND METHOD OF COMPENSATING FOR INJECTOR VARIABILITY

[75] Inventor: Eric Darvin Thomas, Canton, Mich.

[73] Assignee: Detroit Diesel Corporation, Detroit, Mich.

[21] Appl. No.: 866,521

[22] Filed: Jun. 4, 1997

[51] Int. Cl.[6] ..... F02M 51/00

[52] U.S. Cl. ..... 123/478

[58] Field of Search ..... 123/478, 480, 123/472, 491, 446, 682, 693; 239/1, 585.4; 29/602.1; 1/55

[56] References Cited

U.S. PATENT DOCUMENTS 4,379,332 4/1983 Busser et al. .
4,402,294 9/1983 McHugh et al. .
4,790,277 12/1988 Schechter .
5,289,627 3/1994 Cerny et al. ..... 29/602.1
5,295,627 3/1994 Wahba ..... 239/585.4
5,392,995 2/1995 Wahba ..... 239/585.4
5,577,663 11/1996 Nally et al. ..... 239/1
5,634,448 6/1997 Shinogle et al. .
5,671,716 9/1997 Hetrick et al. ..... 23/491
5,682,868 11/1997 Moraal ..... 123/682

*Primary Examiner*—Raymond A. Nelli
*Attorney, Agent, or Firm*—Brooks & Kushman P.C.

[57] ABSTRACT

Electronically controlled fuel injectors are capable of complex injection control methods, such as split injection. A calibration code assigned to each injector is used by a logic controller to determine calibrated energizing times based on raw energizing times determined by the engine control unit. Each injector may be individually calibrated to compensate for injector variability, and facilitate balanced power output from each cylinder.

20 Claims, 3 Drawing Sheets

SYSTEM AND METHOD OF COMPENSATING FOR INJECTOR VARIABILITY

TECHNICAL FIELD

The present invention relates to a system and method for compensating for injector variability in a fuel injector utilizing an electronic control valve for controlling fuel injection.

BACKGROUND ART

In the control of fuel injection systems, the conventional practice utilizes electronic control units having volatile and non-volatile memory, input and output driver circuitry, and a processor capable of executing a stored instruction set, to control the various functions of the engine and its associated systems. A particular electronic control unit communicates with numerous sensors, actuators, and other electronic control units necessary to control various functions, which may include various aspects of fuel delivery, transmission control, or many others.

Fuel injectors utilizing electronic control valves for controlling fuel injection have become widespread. This is due to the precise control over the injection event provided by electronic control valves. In operation, the electronic control unit determines an energizing time for the control valve corresponding to current engine conditions.

One problem associated with fuel injectors is that injector manufacturing tolerances and variability make it difficult to achieve uniform injection from each injector during each injection event. Further, injector manufacturing variability makes it very difficult to achieve balanced power output from each cylinder. This manufacturing variability from injector to injector makes complex injection control methods, such as split injection, very difficult to achieve.

SUMMARY OF THE INVENTION

It is, therefore, an object of the present invention to provide a system and method for compensating for injector variability in a fuel injector.

It is another object of the present invention to provide an improved fuel injector utilizing an electronic control valve for controlling fuel injection which facilitates achieving balanced power output from each cylinder.

In carrying out the above objects and other objects and features of the present invention, a system and method are provided. The method comprises establishing reference energizing times for an injector. The reference energizing times correspond to desired fuel injection characteristics at predetermined engine conditions. True energizing times are determined by injector testing, and correspond to the same predetermined engine conditions. A calibration code is assigned to each injector, and is based on the true energizing times for that injector relative to the established reference energizing times.

In a system according to the present invention, a logic controller determines calibrated energizing times for each injection event based in part on the calibration code and in part on raw energizing times determined by an engine controller.

The advantages accruing to the present invention are numerous. For example, the system and method of the present invention provides compensation for injector variability to achieve uniform injection from each injector during each injection event. The correction of injector variability makes complex injection methods such as split injection possible and practical, and facilitates balancing power output from each cylinder.

The above objects and other objects, features, and advantages of the present invention will be readily appreciated by one of ordinary skill in the art from the following detailed description of the best mode for carrying out the invention when taken in connection with the accompanying drawings.

BEST MODE FOR CARRYING OUT THE INVENTION

Figure 1:
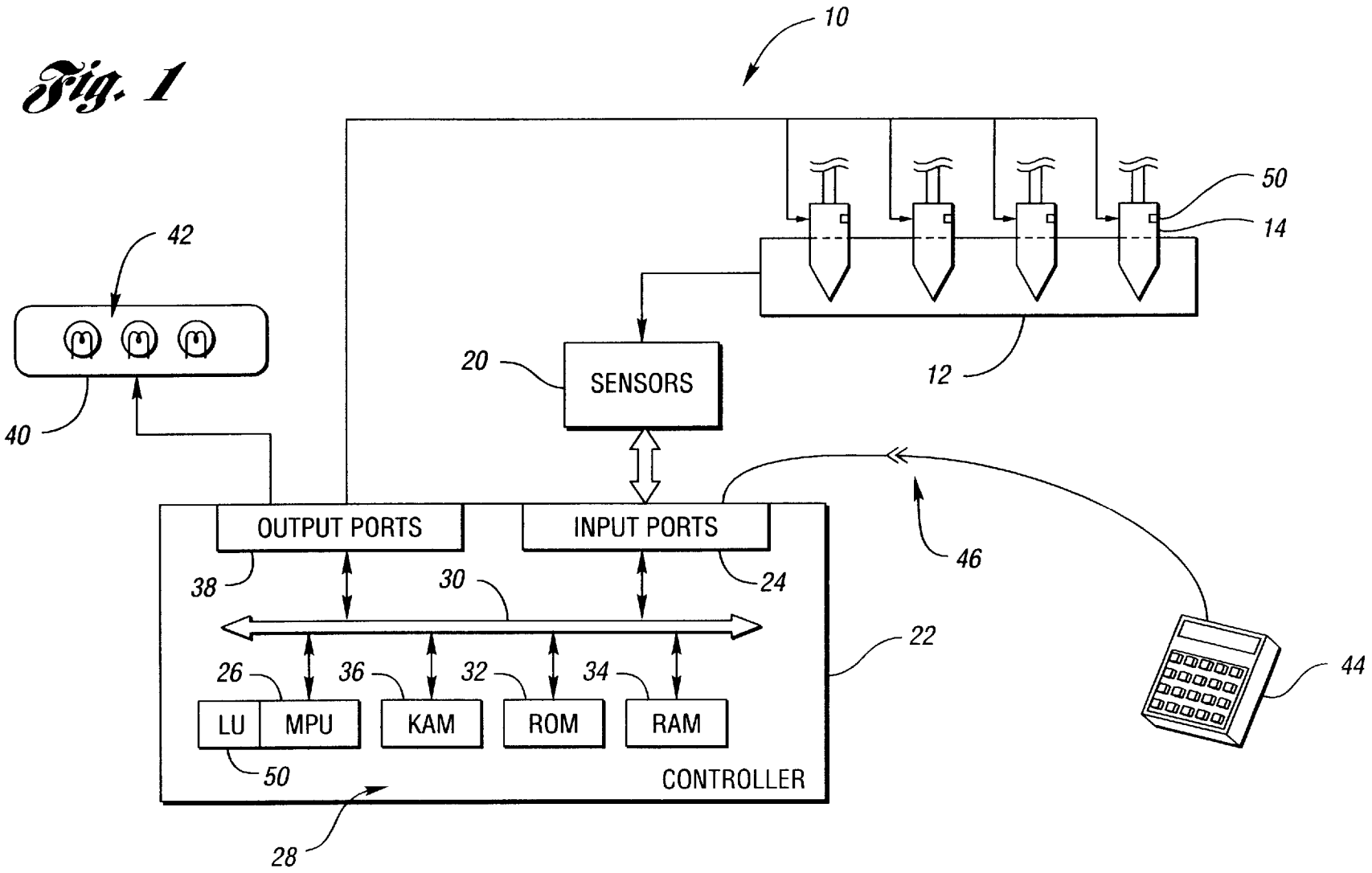
FIG. 1 is a schematic diagram of a fuel injection system made in accordance with the present invention.

Referring now to FIG. 1, a system of compensating for injector variability is shown. The system, generally indicated by reference numeral 10, includes an engine 12 having a plurality of cylinders, each fed by corresponding fuel injectors 14. In a preferred embodiment, engine 12 is a compression-ignition internal combustion engine, such as a four-cylinder or six-cylinder diesel engine.

The system 10 may also include various sensors 20 for generating signals indicative of corresponding operational conditions or parameters of engine 12, the vehicle transmission (not shown), and other vehicular components. Sensors 20 are in electrical communication with a controller 22 via input ports 24. Controller 22 preferably includes a microprocessor 26 in communication with various computer readable storage media 28 via data and control bus 30. Computer readable storage media 28 may include any of a number of known devices which function as a read-only memory (ROM) 32, random access memory (RAM) 34, keep-alive memory (KAM) 36, and the like. The computer readable storage media may be implemented by any of a number of known physical devices capable of storing data representing instructions executable via a computer such as controller 22. Known devices may include, but are not limited to, PROM, EPROM, EEPROM, flash memory, and the like in addition to magnetic, optical, and combination media capable of temporary or permanent data storage.

Computer readable storage media 28 include various program instructions, software, and control logic to effect control of various systems and subsystems of the vehicle, such as engine 12, vehicle transmission, and the like. Controller 22 receives signals from sensors 20 via input ports 24 and generates output signals which may be provided to various actuators and/or components via output ports 38. Signals may also be provided to a display device 40 which includes various indicators such as lights 42 to communicate information relative to system operation to the operator of the vehicle.

A data, diagnostics, and programming interface 44 may also be selectively connected to controller 22 via a plug 46 to exchange various information therebetween. Interface 44 may be used to change values within the computer readable storage media 28, such as configuration settings, calibration variables including injector calibration codes and energizing time look-up tables, control logic, and the like.

In operation, controller 22 receives signals from sensors 20 and executes control logic embedded in hardware and/or software to compensate for injector variability, facilitating the achievement of balanced power output from each cylinder. In a preferred embodiment, controller 22 is the DDEC controller available from Detroit Diesel Corporation, Detroit, Michigan. Various other features of this controller are described in detail in U.S. Pat. Nos. 5,477,827 and 5,445,128, the disclosures of which are hereby incorporated by reference in their entirety.

With continuing reference to FIG. 1, a logic controller, such as logic unit 50, controls the signals sent to the fuel injectors 14. Logic unit 50 computes calibrated energizing times by processing the raw energizing times which correspond to current engine conditions. The calibrated energizing times are determined from the raw energizing times based on calibration codes assigned to each injector as will be described. Logic unit 50 may be included in the functions of microprocessor 26, or may be implemented in any other manner known in the art of hardware and software control systems. It will be appreciated that logic unit 50 may be a part of controller 22, or may be an independent control unit which is in communication with controller 22.

Each injector 14 includes storage media 52 which contains the calibration code for that injector. The calibration code may be stored in any of a variety of storage media types such as those previously described or alternatively may be bar coded or stamped on the injector during production. In a preferred embodiment, control unit 50 is programmed with the appropriate calibration codes at injector installation. Alternatively, control unit 50 may be connected to storage media 52 by a data bus, and may then read the calibration codes at each engine start-up.

As will be appreciated by one of ordinary skill in the art, the control logic may be implemented or effected in hardware, software, or a combination of hardware and software. The various functions are preferably effected by a programmed microprocessor, such as contained in the DDEC controller, but may include one or more functions implemented by the dedicated electric, electronic and integrated circuit. As will also be appreciated, the control logic may be implemented using any one of a number of known programming and processing techniques or strategies and is not limited to the order or sequence illustrated here for convenience. For example, interrupt or event driven processing is typically employed in real-time control applications, such as control of a vehicle engine or transmission. Likewise, parallel processing or multi-tasking systems and methods may be used to accomplish the objects, features, and advantages of the present invention. The present invention is independent of the particular programming language, operating system, or processor used to implement the control logic illustrated.

Figure 2:
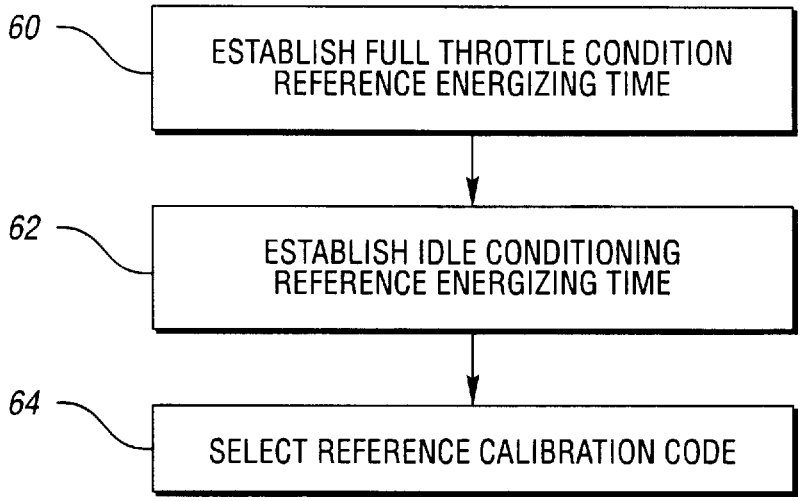
FIG. 2 is a block diagram illustrating a method of establishing reference energizing times for the injectors in accordance with the present invention.

Referring to FIG. 2, a method of the present invention is illustrated. An electronic control unit, such as controller 22 (FIG. 1), determines raw energizing times for the electronically controlled fuel injectors based on a variety of engine operating conditions as determined by the numerous vehicle sensors. Since all fuel injectors are not identical due to manufacturing tolerances and variability, the use of raw energizing times to operate fuel injector control valves results in unbalanced cylinder power output.

Methods of the present invention allow for individual calibration of each fuel injector to facilitate balancing engine cylinder output. At step 60, a reference energizing time is established for full throttle engine conditions. At step 62, a reference energizing time is established for engine idle conditions. These reference energizing times are preferably the respective raw energizing times for engine full throttle and engine idle conditions, and are the same for all injectors regardless of injector variability. The established reference times may be determined by taking average times from injector testing, determined empirically, or arbitrarily selected.

Figure 5:
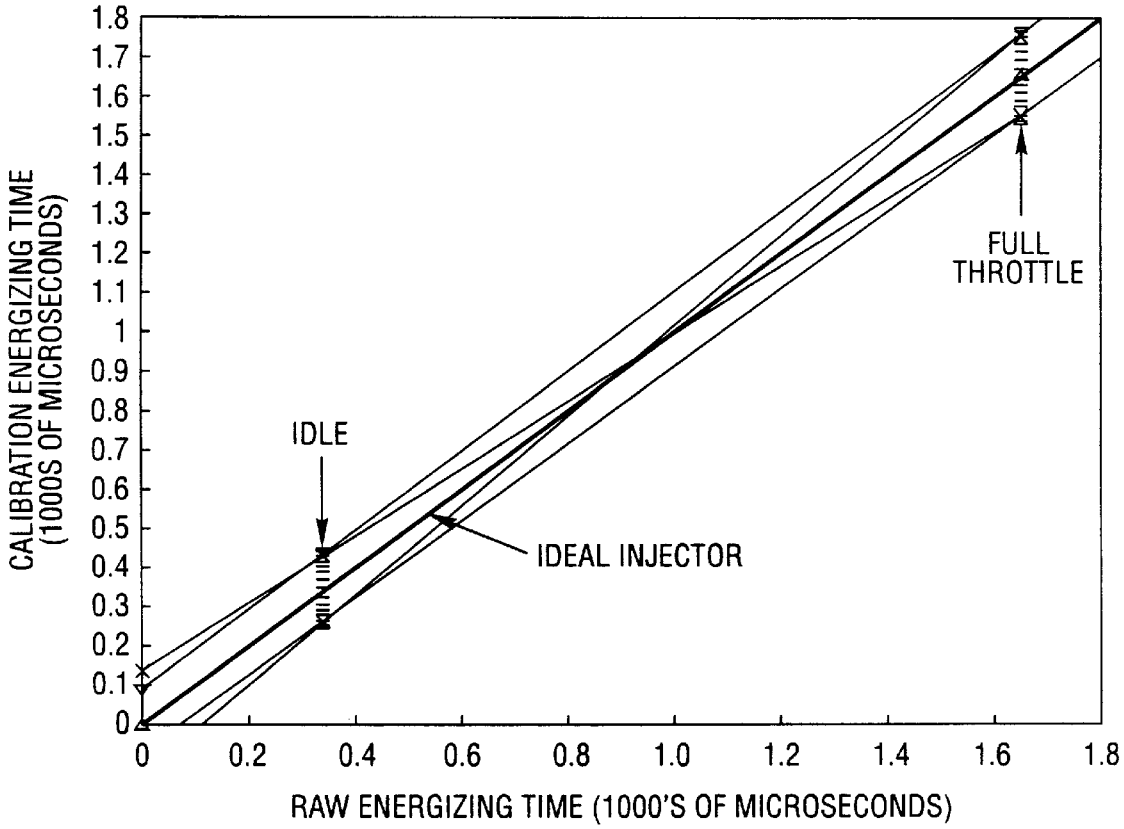
FIG. 5 is a graph of calibrated energizing times versus raw energizing times in accordance with the present invention.

These two established reference times, 60 and 62, determine the expected behavior of an ideal injector, an example of which is best shown in FIG. 5. For example, an ideal fuel injector may deliver 670 $mm^3$ at 120 MPa injection pressure in a full throttle reference energizing time of 1,650 $\mu$s. At engine idle conditions, the ideal injector may deliver, for example, 100 $mm^3$ of fuel at 60 MPa injection pressure in a reference idle energizing time of 345 $\mu$s.

With continuing reference to FIG. 2, at step 64 a reference calibration code is arbitrarily selected for an ideal injector. For example, a coding system may include one hundred distinct codes, one of which represents an ideal injector. The other available codes each represent injectors of differing injection characteristics than the ideal injector. In a preferred embodiment, each calibration code is a two-digit code selected from a group of codes ranging from "00" to "99". One of these codes is reserved for the ideal injector, and may be arbitrarily selected.

In a preferred embodiment, the calibration codes are randomly distributed among the calibration value pairs. The random distribution is meant to prevent tampering by an end user to modify fuel injection pulse width.

Figure 3:
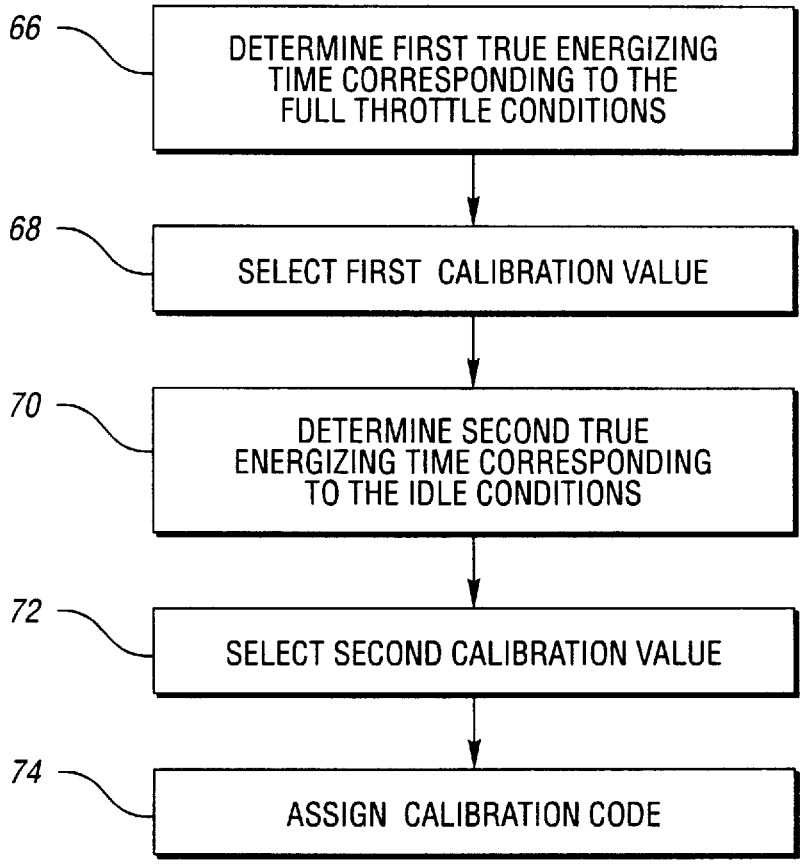
FIG. 3 is a block diagram illustrating a method of selecting injector calibration codes in accordance with the present invention.

Referring to FIG. 3, a method of the present invention is illustrated. For each injector manufactured, true energizing times are measured for both full throttle conditions and idle conditions. At step 66, a first true energizing time corresponding to full throttle conditions is determined. At step 68, a first calibration value is selected based on the first true energizing time determined at step 66. The first calibration value represents the difference between the first true energizing time 66 and the first reference energizing time established at step 60 (FIG. 2). In a preferred embodiment the first calibration value is an integer ranging from −5 to +5. A calibration value of 0 corresponds to the reference energizing time of step 60. In either the positive or negative direction, each integer represents a difference of 20 $\mu$s in the true energizing time from the established reference energizing time.

A second true energizing time corresponding to engine idle conditions is determined at step 70. At step 72, a second calibration value is selected based on the second true energizing time determined at step 68. The second calibration value represents the difference between the second true energizing time 70 and the second reference energizing time established at step 62 (FIG. 2). In a preferred embodiment the second calibration value is an integer ranging from −4 to +4. A calibration value of 0 corresponds to the reference energizing time of step 62. In either the positive or negative direction, each integer represents a difference of 20 $\mu$s in the true energizing time from the established reference energizing time.

At step 74, based on the first and second calibration values, a calibration code is selected. The calibration code is selected from a plurality of predetermined calibration codes which represent distinct combinations of calibration values.

It is to be appreciated that engine idle and full throttle are one example of engine conditions that can be used for calibration. Other engine conditions, or additional engine conditions may be tested such as one-half throttle. Alternatively, greater resolution may be obtained by using a smaller time increment per calibration value increment, and a larger range for each calibration value such as +/−10. Further, it is to be appreciated that the calibration values need not be spaced apart at equal energizing time intervals. The amount of energizing time between consecutive calibration values may vary to produce areas of greater resolution.

As best shown in FIG. 5, the first and second calibration values define a line which determines the calibrated energizing times for all engine conditions ranging from engine idle to engine full throttle. It is to be understood that there are many techniques for modeling calibrated energizing time based on measured true energizing times. In a preferred embodiment, two-point linear interpolation is used. Similar calibration may be obtained using any number of sample points, and higher order modeling techniques. Another alternative method of modeling calibrated energizing times is to determine true energizing time at one-half throttle, and utilize a straight offset from raw energizing times.

Figure 4:
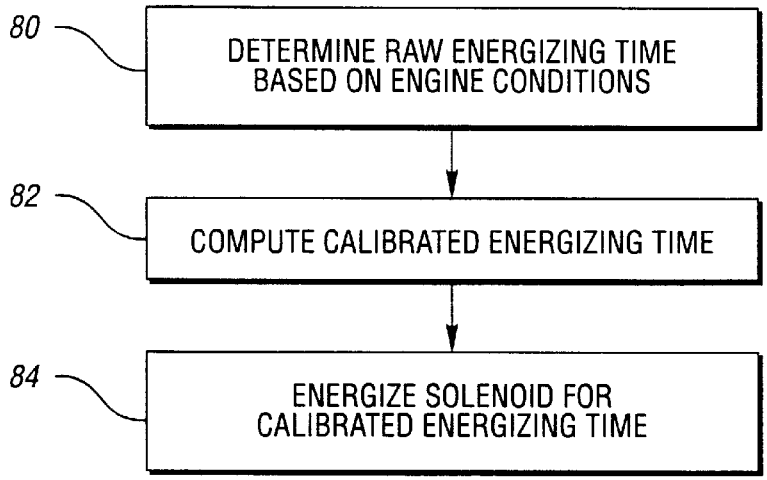
FIG. 4 is a block diagram illustrating a method of operating an injector in accordance with the present invention.

Referring to FIG. 4, a method of operating a fuel injector in accordance with the present invention is illustrated. At step 80, a raw energizing time for the solenoid is determined based on current engine conditions. At step 82, calibrated energizing time is computed according to a calibrated energizing time function, such as two-point linear interpolation, which maps raw energizing time to calibrated energizing time. The computation of the calibrated energizing times is performed by logic unit 50 (FIG. 1). These computations may be performed in any of a variety of methods known in the art of control systems, and are preferably performed via look-up tables indexed by raw energizing time. At step 84, the solenoid is energized for the calibrated energizing time, providing separately calibrated fuel injection at each cylinder.

Referring now to FIG. 5, a graph of calibrated energizing time versus raw energizing time is illustrated. As indicated, a graph for an ideal injector has a slope equal to 1. On the same set of axes, several calibrated energizing time functions are illustrated. As shown, the calibrated energizing time at engine idle conditions may vary +/−80 $\mu$s (+/−4 increments) from that of the ideal injector. The calibrated energizing time at engine full throttle may vary +/−100 $\mu$s (+/−5 increments) from that of the ideal injector.

It should be appreciated that the present invention facilitates the achieving of balanced power output from each cylinder in an internal combustion engine. Each fuel injector is individually calibrated according to true energizing times determined in testing prior to installation.

While the best mode contemplated for carrying out the invention has been described in detail, those familiar with the art to which this invention relates will recognize various alternative designs and embodiments for practicing the invention as defined by the following claims.

What is claimed is:

1. A method of calibrating an electronically controlled fuel injector, the method comprising the steps of:

establishing reference energizing times which correspond to fuel injection at each of at least two predetermined engine conditions;

determining true energizing times for the injector which correspond to fuel injection at each of the predetermined engine conditions;

selecting one of a plurality of predetermined calibration categories for each engine condition based on each true energizing time relative to the corresponding reference energizing time;

assigning a calibration code to the injector indicative of the calibration categories; and marking the injector with the calibration code.

2. The method of claim 1 wherein the predetermined engine conditions include engine full throttle conditions.

3. The method of claim 1 wherein the predetermined engine conditions include engine idle conditions.

4. The method of claim 1 wherein the step of establishing a reference energizing time comprises the steps of:

establishing a first reference energizing time which corresponds to fuel injection at engine full throttle conditions; and establishing a second reference energizing time which corresponds to fuel injection at engine idle conditions.

5. The method of claim 4 wherein the step of determining a true energizing time for the injector comprises the steps of:

determining a first true energizing time for the injector which corresponds to fuel injection at engine full throttle conditions; and determining a second true energizing time for the injector which corresponds to fuel injection at engine idle conditions.

6. The method of claim 5 wherein the step of selecting a calibration category comprises the steps of:

selecting a first calibration category based on the first true energizing time relative to the first reference energizing time; and selecting a second calibration category based on the second true energizing time relative to the second reference energizing time, wherein the first calibration category is selected from a corresponding first plurality of available calibration categories and the second calibration category is selected from a second plurality of available calibration categories.

7. The method of claim 6 wherein the calibration code is indicative of the first and second calibration categories.

8. The method of claim 7 wherein the first plurality of calibration categories has a different number of calibration categories than the second plurality of predetermined calibration categories.

9. The method of claim 7 further comprising the step of:

determining a calibrated energizing time function for the injector based on the first and second true energizing times, the calibrated energizing time function mapping raw energizing times to corresponding calibrated energizing times for the injector.

10. The method of claim 9 wherein the calibrated energizing time function is defined by two-point linear interpolation between the first and second calibration categories.

11. The method of claim 6 wherein the first plurality of calibration categories corresponds to a first range of equally spaced apart calibration values, the second plurality of calibration categories corresponds to a second range of equally spaced apart calibration values, and the first and second plurality of calibration categories define a plurality of calibration pairs, each pair defining a calibrated energizing time function mapping raw energizing times to corresponding calibrated energizing times for the injector.

12. The method of claim 1 wherein the injector includes a storage medium and wherein the step of marking the injector comprises the step of:

storing the calibration code in the memory storage medium for subsequent use by an engine control unit.

13. A system for compensating for injector variability of an electronically controlled fuel injector, the system comprising:

an internal combustion engine having a plurality of electronically controlled fuel injectors each having an associated calibration code based on first and second pluralities of calibration categories corresponding to deviation of true energizing times of the injector relative to reference energizing times at first and second engine operating conditions;

a logic controller in communication with the plurality of injectors, the logic controller determining a raw energizing time corresponding to current engine operating conditions for each injector, and computing a calibrated energizing time based on the calibration code for the injector using linear interpolation between energization times associated with the first and second calibration categories.

14. The system of claim 13 wherein the calibration code is programmed into the logic controller at injector installation, the calibration code then being available to the logic controller as needed during injector operation.

15. A system for compensating for injector variability in electronically controlled fuel injectors in an internal combustion engine, the system comprising:

a plurality of fuel injectors, at least one of the injectors having a calibration code based on true energizing times relative to reference energizing times for each of a plurality of predetermined engine conditions; and an electronic control unit which determines raw energizing times for the injectors based on current engine operating conditions determines calibrated energizing times for the at least one injector by linearly interpolating between energizing times associated with the respective calibration code and corresponding calibration categories, and energizes each injector for the calibrated energizing time.

16. The system of claim 15 wherein each injector of the plurality of injectors has a calibration code allowing separate calibration of each injector to facilitate balanced power output from each cylinder.

17. The system of claim 16 wherein calibrated energizing times are located within a look-up table indexed by raw energizing times.

18. The system of claim 16 wherein each calibration code is a two-digit code selected from a group of codes ranging from "00" to "99".

19. A computer readable storage medium having stored therein data representing instructions executable by a microprocessor to compensate for fuel injector variability during control of an internal combustion engine, the computer readable storage medium comprising:

instructions for determining a raw energizing time for a fuel injector;

instructions for determining a calibration code for the injector;

instructions for determining a first calibration category corresponding to true energizing time of the injector relative to a first reference energizing time for a first engine operating condition and a second calibration category corresponding to true energizing time of the injector relative to a second reference energizing time for a second engine operating condition; and instructions for determining a calibrated energizing time for the injector based on the raw energizing time and the first and second calibration categories.

20. The computer readable storage medium of claim 19 further comprising:

instructions for determining the calibrated energizing time using linear interpolation between energizing times associated with the first and second calibration categories corresponding to the calibration code of the injector.

* * * * *